United States Patent [19]

Poling

[11] Patent Number: 4,713,990

[45] Date of Patent: Dec. 22, 1987

[54] BOLT EXTRACTING TOOL

[76] Inventor: Denzil C. Poling, Rte. 6, Box 80, Hagerstown, Md. 21740

[21] Appl. No.: 886,684

[22] Filed: Jul. 18, 1986

[51] Int. Cl.[4] ..... B25B 13/50

[52] U.S. Cl. ..... 81/53.2; 81/57.33; 81/186; 408/206

[58] Field of Search ..... 81/53.2, 464, 465, 466, 81/57.33, 186; 30/277, 167; 408/211, 212, 213, 227, 228

[56] References Cited

U.S. PATENT DOCUMENTS

| | | | |
|---|---|---|---|
| 906,040 | 12/1908 | Lucas . | |
| 1,041,440 | 10/1912 | Decker . | |
| 1,093,252 | 4/1914 | Carnes . | |
| 1,179,680 | 4/1916 | Tallyn . | |
| 1,785,847 | 12/1930 | Valentine | 81/53.2 |
| 2,622,466 | 12/1952 | Vanden Bos et al. . | |
| 2,750,821 | 6/1956 | Hilsinger | 81/53.2 |
| 3,157,074 | 11/1964 | Durkee | 81/466 |

*Primary Examiner*—Frederick R. Schmidt
*Assistant Examiner*—Maurina Rachuba
*Attorney, Agent, or Firm*—Bernard, Rothwell & Brown

[57] ABSTRACT

The biting edges of a toothed bit are forced into a damaged bolt or the like and rotated by operation of an impact wrench coupled to the toothed bit to rotationally disengage and extract the damaged bolt.

10 Claims, 13 Drawing Figures

BOLT EXTRACTING TOOL

BACKGROUND OF THE INVENTION

Field of the Invention

The present invention relates to extraction of threaded bolts and the like having rounded or otherwise damaged heads. Description of the Background Art Removal of bolts having rounded heads or bolts that are damaged to such an extent that they cannot be removed in the usual manner, typically involves drilling a hole into the bolt and insertion therein a tool called an "easy out" for removal.

One device for removing threaded screws and the like having destroyed or broken-off heads is disclosed in expired U.S. Pat. No. 1,785,847 to Valentine. The Valentine device includes a threaded member axially disposed within a toothed screw-moving member, and requires that the damaged screw be drilled and tapped. The teeth of the screw-moving member have edges which are perpendicular to the axis of the device, and are forced to dig into the material of the damaged screw by rotation of a nut against the axially disposed threaded member screwed into the drilled and tapped hole in the damaged screw.

An obvious drawback of devices which require drilling and tapping of a damaged screw or bolt is the time involved to effect such drilling and tapping. Drilling of the damaged screw or bolt may contaminate a gearcase with metal fillings making complete drainage and cleaning necessary. Lack of electric current for field work further complicates drilling the damaged bolt.

Toothed bolt extracting-type devices which do not require drilling and tapping of a damaged bolt or screw have been proposed. Examples of such devices are shown in expired U.S. Pat. Nos. 906,040; 1,093,252 and 1,179,680. Other toothed devices for turning threaded members are shown in expired U.S. Pat. Nos. 1,041,440 and 2,622,466.

Prior art bolt extractors of the type which do not utilize drilling and tapping of the damaged bolt or screw have not been generally adopted for reasons which may include principal reliance of such devices on a substantial amount of manually applied rotational force.

There remains a need in the art for an easy-to-use bolt extracting tool which does not require drilling and tapping of a damaged bolt.

SUMMARY OF THE INVENTION

The present invention utilizes a bit having teeth with biting edges which first are hammered into a first threaded member, such as a bolt with a rounded head. This axial force may be applied by a hand-held hammer or by a pneumatic hammer. The teeth extend from one end of a body portion of the bit and are disposed about an axis of rotation of the body portion of the bit. The body portion includes a shank end opposite the end with the teeth, the shank end being operatively connected to an impact wrench for forced rotation of the bit by operation of the impact wrench while forcing the biting edges of the teeth into the bolt.

DETAILED DESCRIPTION OF THE PREFERRED EMBODIMENTS

Figure 1A:
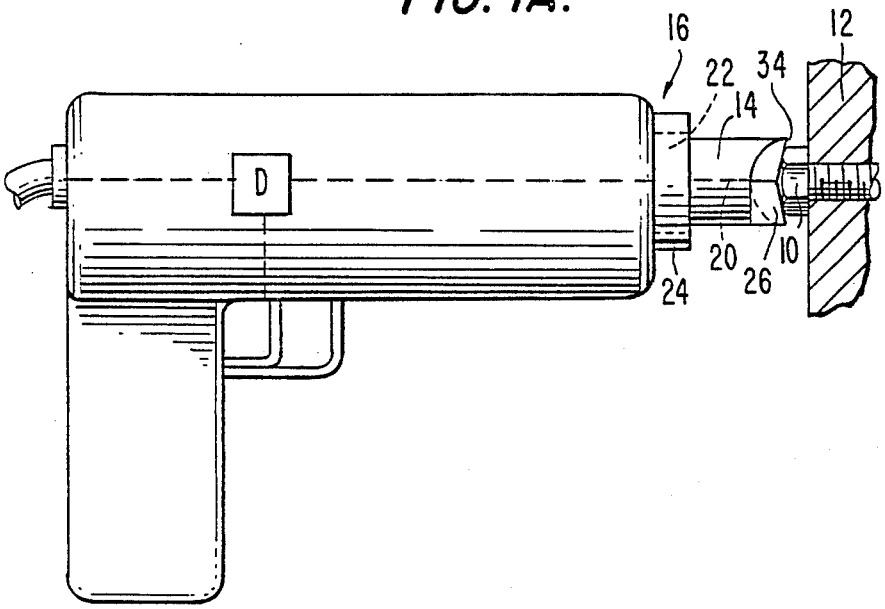
FIG. 1A is an elevational view, partly schematic, showing removal of a damaged bolt with a bolt extracting tool operated by a pneumatically operated impact wrench in accordance with the present invention.
Figure 1B:
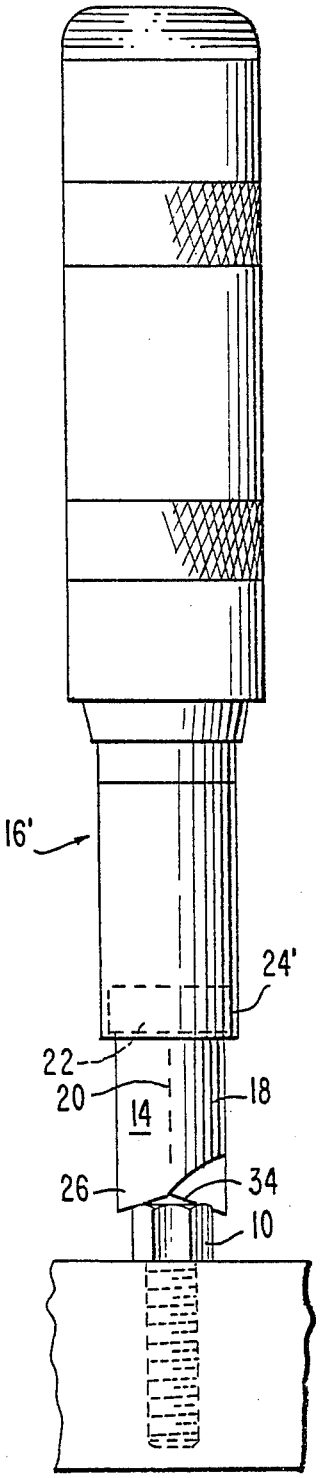
FIG. 1B is a side elevation view showing removal of a damaged bolt with a bolt extracting tool operated by a manual impact wrench in accordance with the present invention.

The present invention provides for a quick rotational engagement of a first threaded member such as a rounded head or otherwise damaged bolt 10 from a second threaded member 12 threadably engaged therewith. See FIGS. 1A and 1B. The damaged bolt 10 is removed by means including a bolt extracting bit 14 forceably rotated by a conventional, pneumatically operated impact wrench 16 or a manual impact wrench 16' engaged with bit 14.

With reference to FIGS. 1A, 1B, and 2A–2D, the bit 14 includes a body portion 18 having an axis of rotation 20.

Body 18 of bit 14 includes a shank end 22 adapted to mate with and rotationally engage a rotatable, complementary engaging member 24 or 24' of impact wrench 16 or 16', respectively. Such engagement allows forced rotation of bit 14 by impact wrench 16 or 16' about the axis of rotation 20 of bit body 18.

A pair of teent 26 extend from another end of the bit body opposite shank 22, the pair of teeth being symmetrically disposed about axis 20 of body 18. Each tooth 26 includes a first substantially planar face 28 which is substantially parallel with the axis 20 of body 18. Note FIGS. 2C and 2D.

Each tooth 26 further includes a second face 30 which forms with the first face 28 an acute angle 32 defining a biting edge 34 of tooth 26. The second face 30 of tooth 26 passes through and intersects with a line 36 perpendicular to a first planar face 28. See FIG. 2D. An angle 32 of about 45° has been found to provide sufficient strength to teeth 26 while also providing good biting ability to biting edge 34.

Figure 2A:
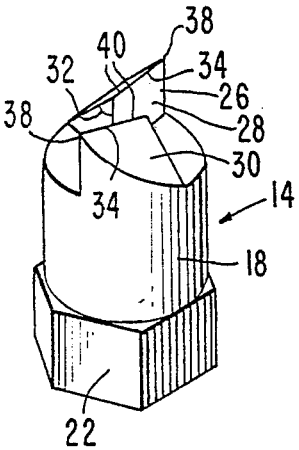
FIG. 2A is a perspective view of a bolt extracting tool according to one embodiment of the invention.
Figure 2B:
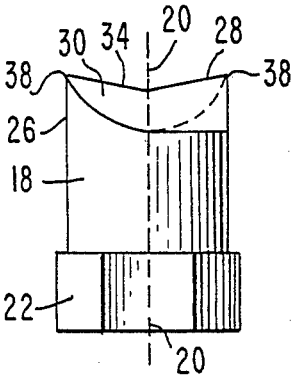
FIG. 2B is a side elevation view of the tool shown in FIG. 2A.
Figure 2C:
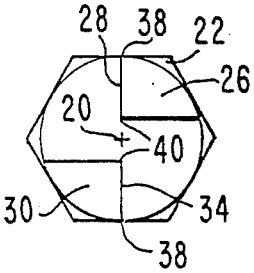
FIG. 2C is a top elevation view of the tool shown in FIG. 2A.
Figure 2D:
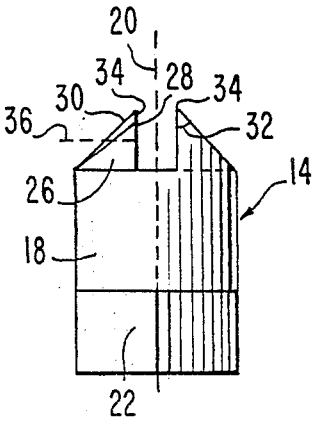
FIG. 2D is another side elevation view of the tool shown in FIG. 2A.

Biting edge 34 includes a peripheral end 38 disposed away from the body axis 20 and an inner portion 40 between the peripheral end 38 and the body axis 20. Compare FIGS. 2A–2C. According to this embodiment, biting edge 34 is inclined towards shank end 22 from the peripheral end 38 of edge 34 to the inner portion 40 of edge 34. FIG. 2B clearly illustrates that, of bit portions at the toothed end of bit body 18, the peripheral ends 38 of teeth 26 extend farthest from the shank end 22 when measured from the body axis 20 at the shank end.

Referring back to FIG. 1, the shank end 22 of bit 18 is mated with and rotationally engaged with complementary engaging member 24 of impact wrench 16. For extracting damaged bolt 10 from threaded member 12, the bit biting edges 34 of bit teeth 26 are forced into the damaged head of bolt 10. The bit then is rotated by operation of the impact drive D while forcing the biting edges of the teeth against damaged bolt 10. This causes the biting edges 34 of the teeth to bite into the head of damaged bolt 10 and thereby rotationally disengage and extract bolt 10 from threaded member 12.

Figure 3A:
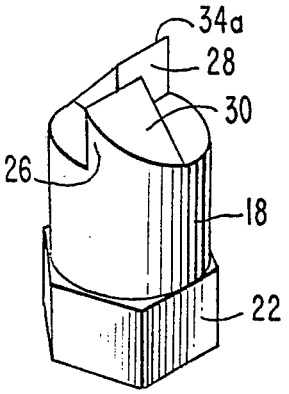
FIG. 3A is a perspective view of a bolt extracting tool according to another embodiment of this invention.
Figure 3B:
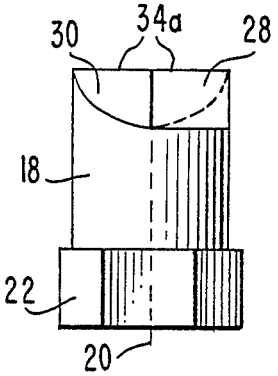
FIG. 3B is a side elevation view of the tool shown in FIG. 3A.
Figure 3C:
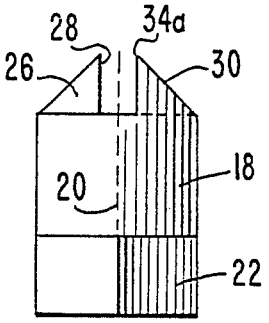
FIG. 3C is another side elevation view of the tool shown in FIG. 3A.

FIGS. 3A–3C illustrate a bit according to a second embodiment of the present invention wherein parts having a similar function to the previously described bit have the same reference numerals. This embodiment differs from the previously described embodiment in that biting edges **34*a* are perpendicular to body axis 20**, the bits being otherwise similar.

Figure 4A:
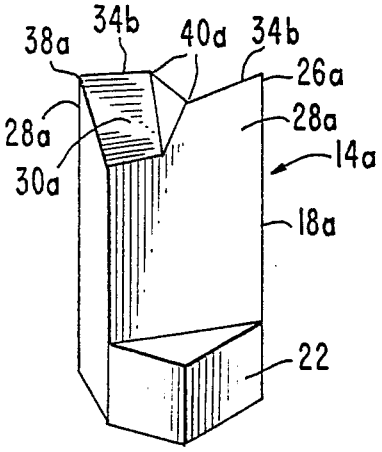
FIG. 4A is a perspective view of a bolt extracting tool according to a further embodiment of this invention.
Figure 4B:
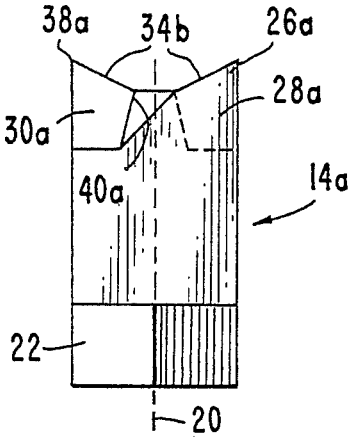
FIG. 4B is a side elevation view of the tool shown in FIG. 4A.
Figure 4C:
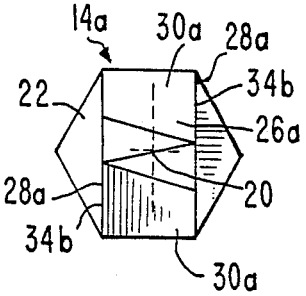
FIG. 4C is a top elevation view of the tool shown in FIG. 4A.

FIGS. 4A–4C illustrate still another embodiment of the invention wherein the body portion **18*a* of bit 14*a* is illustrated as being rectangular, but could be any suitable shape. According to this embodiment, biting edge 34*b* is inclined towards the shank end 22 from the peripheral end 38*a* of biting edge 34*b* to the inner portion 40*a* of biting edge 34*b* to the inner described embodiments, the teeth 26*a* of bit 14*a* each include a first substantially planar face 28*a* which is substantially parallel with the body axis 20. A second face 30*a* of tooth 26*a* forms with the first face 28*a* an acute angle defining a biting edge 34*b* of the tooth 26*a***.

Figure 5:
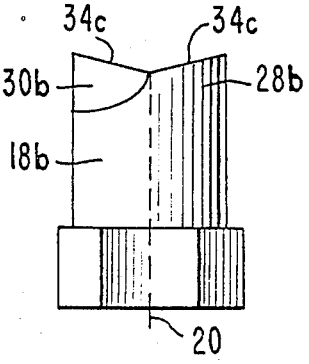
FIG. 5 is a side elevation view of a bolt extracting tool according to yet another embodiment of this invention.

Yet another embodiment is illustrated in FIG. 5. The embodiment shown in FIG. 5 is similar to the embodiment shown in FIGS. 4A–4C in that biting edges **34*c* are perpendicular to the axis of rotation 20 of body 18*b*. Note that as in the previously described embodiments, planar face 28*b* forms with the second face 30*b* an acute angle defining biting edge 34*c***.

Utilization of a bit according to the invention with a manual or pneumatic impact wrench provides for easy and reliable withdrawal of damaged bolts without the necessity of drilling, tapping and the like.

Since many modifications, variations and changes in detail may be made to the described embodiments, it is intended that all matter in the foregoing description and shown in the accompanying drawings be interpreted as illustrative and not in a limiting sense.

What is claimed is:

1. In combination (a) a bit for being hammered into bolts for extracting bolts comprising a body having an axis of rotation, the body including a shank end adapted to mate with and rotationally engage a rotatable complementary engaging member of an impact wrench, engagement of which allows forced rotation of the bit by the impact wrench, the body having a toothed end opposite the shank, the toothed end of the bit body having only two bolt-engageable teeth disposed symmetrically about the axis of the body and about a line perpendicular to the axis of rotation of the body at another end of the body opposite the shank end the shank end having an impact surface perpendicular to the axis of rotation of the body for being hammered for driving the biting edge of each tooth into the bolt, each of the teeth of the bit including a biting edge diposed away from the shank end for being driven into a bolt by hammering the shank end and thereby engaging and biting the teeth into a bolt to be extracted, each of the biting edges of the teeth being defined by an acute angle formed between a first planar working face and a second face, said first planar working face being parallel with the body axis for acting against a corresponding surface formed by a hammering the tooth in the bolt for rotating the bolt, said second face extending away from the biting edge of each tooth, said second face passing through and intersecting with a line perpendicular to the first planar working face for allowing the teeth to be hammered into the bolt, each of the biting edges being defined by a peripheral end disposed away from the body axis and an inner portion between the peripheral end and the body axis, the biting edge being inclined towards the shank end from the peripheral end to the inner portion of the edge for cutting into the bolt and allowing the teeth to be hammered into the bolt; and (b) an impact wrench including said rotatable complementary engaging member operatively connected to an impact drive, the engaging member mating with and rotatably engaging the shank end of the body for forced rotation of the bit to extract bolts.

2. The combination of claim 1 wherein, of bit portions at the end of the body opposite the shank end, the peripheral ends of the teeth extend farthest from the shank end when measured from the body axis at the shank end.

3. A bit for extracting bolts, comprising:

(a) a body having an axis of rotation, the body including a shank end and a toothed end, the shank end being adapted for being hammered for driving the toothed end into a bolt, the shank end being further adapted to mate with and rotationally engage a rotatable complementary engaging member of an impact wrench, engagement of which allows forced rotation of the bit by the impact wrench about the axis of rotation of the body, having a toothed end opposite the shank, the toothed end of the bit body having only two, the toothed end of the body including a plurality of bolt-engageable teeth disposed symmetrically about the axis of the body and about a line perpendicular to the axis of rotation of the body, each tooth having a first planar working face parallel with the body axis for acting against a corresponding surface formed by the tooth in a bolt for rotating the bolt, each tooth having a second face forming with the first planar working face an acute angle which defines a biting edge of the tooth, the second face passing through and intersecting with a line perpendicular to the plane of the first planar working face for allowing the tooth to be driven into a bolt by hammering the shank end, the biting edge being defined by a peripheral end disposed away from the body axis and an inner portion between the peripheral end and the body axis, the biting edge being inclined towards the shank end from the peripheral end to the inner portion of the edge for cutting into a bolt and allowing the teeth to be hammered into a bolt.

4. The bit of claim 3 wherein, of bit portions at the end of the body opposite the shank end, the peripheral ends of the teeth extend farthest from the shank end when measured from the body axis at the shank end.

5. In combination:

(a) a bit according to claim 3; and (b) an impact wrench including said rotatable complementary engaging member which mates with and rotatably engages the shank end of the body for forced rotation of the bit to extract bolts.

6. In combination:

(a) a bit according to claim 4; and (b) an impact wrench including said rotatable complementary engaging member which mates with and rotatably engages the shank end of the body for forced rotation of the bit to extract bolts.

7. The combination of claim 1 wherein the impact wrench is a manual impact wrench.

8. The combination of claim 1 wherein the impact wrench is a manual impact wrench.

9. The combination of claim 5 wherein the impact wrench is a manual impact wrench.

10. The combination of claim 6 wherein the impact wrench is a manual impact wrench.

* * * * *